United States Patent [19]

Hawkins

[11] Patent Number: 4,734,045

[45] Date of Patent: Mar. 29, 1988

[54] HIGH DENSITY CONNECTOR

[75] Inventor: John L. Hawkins, San Juan Capestrano, Calif.

[73] Assignee: Masterite Industries, Inc., Torrance, Calif.

[21] Appl. No.: 31,044

[22] Filed: Mar. 27, 1987

[51] Int. Cl.[4] ..... H01R 23/70

[52] U.S. Cl. ..... 439/79; 439/592; 439/676; 439/931

[58] Field of Search ..... 439/59–62, 439/65, 78, 79, 80, 592, 593, 660, 676, 931

[56] References Cited

U.S. PATENT DOCUMENTS

| | | | |
|---|---|---|---|
| 2,904,768 | 9/1959 | Rasmussen | 339/17 |
| 3,517,803 | 6/1970 | Frompovicz et al. | 206/56 |
| 3,772,632 | 11/1973 | Rattcliff et al. | 439/931 |
| 3,818,414 | 6/1974 | Davies et al. | 339/17 |
| 3,881,799 | 5/1975 | Elliott et al. | 339/252 |
| 3,909,678 | 9/1975 | Rifkin et al. | 174/15 R |
| 3,941,442 | 3/1976 | Friend | 339/17 |
| 4,076,356 | 2/1978 | Tamburro | 339/17 |
| 4,392,705 | 7/1983 | Andrews, Jr. et al. | 439/79 |
| 4,655,518 | 4/1987 | Johnson et al. | 439/80 |

FOREIGN PATENT DOCUMENTS 2615300 10/1976 Fed. Rep. of Germany .

*Primary Examiner*—Neil Abrams

*Attorney, Agent, or Firm*—Sughrue, Mion, Zinn, Macpeak, and Seas

[57] ABSTRACT

A high density connector for connecting multiple circuits between printed circuit boards or the like is formed of inter-engaging mating, first and second connector halves formed of an electrical insulating material with said connector halves including opposed connection faces having uniform width and height undulations forming alternating flattened peaks and valleys of limited width with the peaks and valleys having an electrically conductive coating thereon to form longitudinally spaced transversely offset contacts at the peaks and valleys. The connection faces of the respective connector halves bear mirror image undulations. The center to center distance between longitudinally adjacent contacts is less than the peak to valley distance between those contacts to increase the electrical creapage path between longitudinally adjacent contacts of the mating first and second connector halves. Circuits are completed between one or more of the connector halves and printed circuit boards or cards fixed thereto by selectively removing a coating of solder mask which overlies extensions of the electrically conductive coatings on the peaks and valleys which extend along companion surfaces of the connector halves with the solder mask coating guaranteeing against shorting between adjacent printed circuit boards during unmating of the connector halves. The printed circuit boards may be co-planar stacked and separated by the joined male and female connector halves or the female connector half which may include a second slot opposite that receiving the male connector half which permits right angle electrical mounting and connecting of a daughter card to an underlying mother board.

7 Claims, 5 Drawing Figures

FIG.1
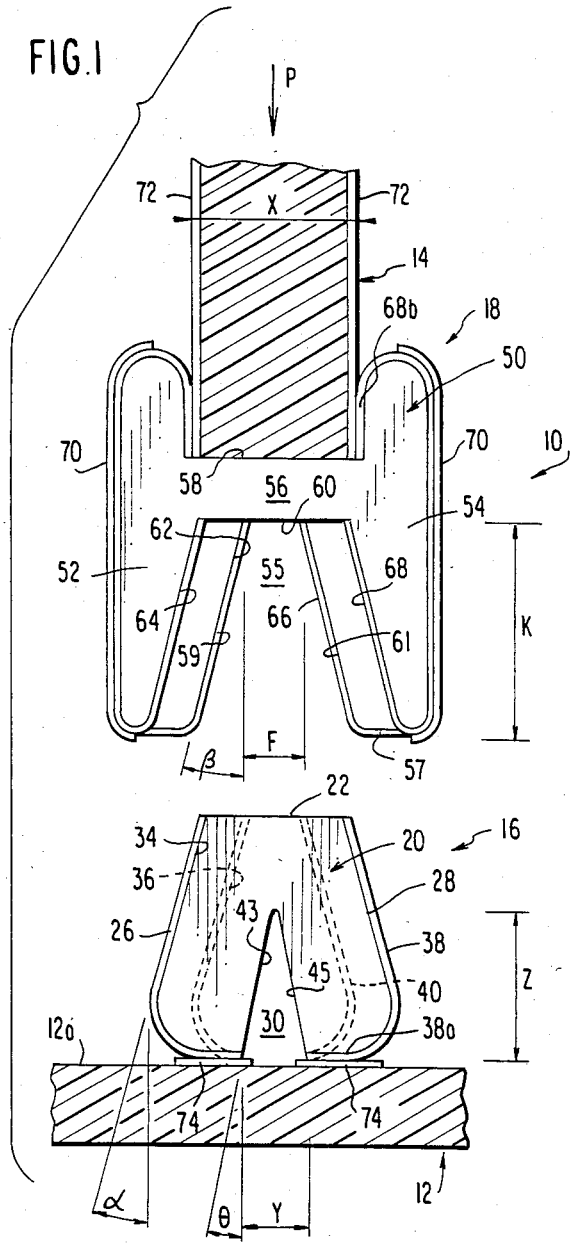
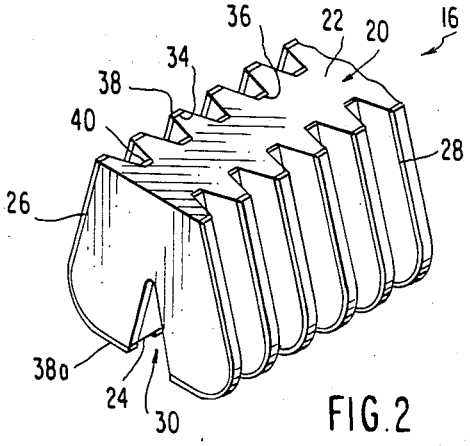
FIG.2
FIG.3
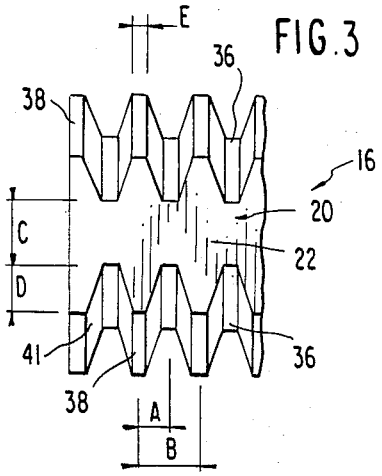
FIG.4
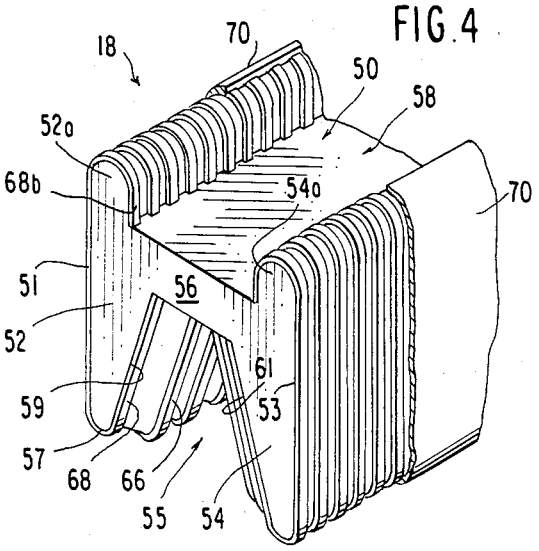
FIG.5
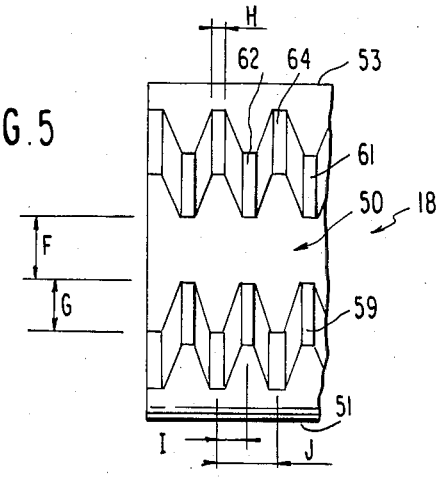

HIGH DENSITY CONNECTOR

FIELD OF THE INVENTION

This invention relates to electrical connectors having mating, mirror image connector bodies in which longitudinally spaced contacts are closely positioned to effect low voltage, low current connections with minimal center line spacing between the contacts.

BACKGROUND OF THE INVENTION

The miniaturization of electronic equipment has led in turn to the miniaturization of structure supporting the electronic elements such as printed circuit boards and the necessity to closely space the contacts of the connectors carried by the boards in achieving interconnection between mother boards, daughter cards, and/or the electrical components carried by the boards or cards. In the miniaturization of connectors, particularly useful in connecting a daughter card to a mother board, or a stack of mother boards or daughter cards in overlying, spaced arrays separated by connector bodies, one connector body or half is carried by a lower card or board a second mating connector body or half is carried by the upper card or board and being in general alignment therewith, it is desirable that the conductors or contacts on the card or board lie at longitudinally spaced positions and in aligned rows with minimal spacing, i.e., preferably on 0.010 inch centers.

The problem experienced by such connectors lies in the shorting between contacts due to their close spacing.

Further, where the connector is formed of mating connector bodies or halves, it is difficult to obtain and maintain alignment between the connector bodies such that the individual conductive components or contacts, on 0.010 inch centers are in alignment and have full face contact therebetween upon completion of the connection between the connector halves. Further, it is desirable that such connectors are sufficiently flexible so that connections may be made between the closely spaced contacts on the connector body or to input lines such as flat cables or flex circuits.

It is therefore a primary object of the present invention to provide an improved connector formed by mating bodies of electrically insulative material having longitudinally spaced metal contacts at minimal center-to-center spacing on mirror image surfaces of the connector body, which inherently provide a greater creepage path than the center-to-center distance between adjacent contacts, which provides a wiping action during connector body mating to guarantee contact integrity, which limits the insertion force to achieve the connection between the connector bodies, which guarantees against shorting between adjacent cards or boards during the unmating of the connector halves and which permits right angle coupling of a daughter card to a mother board, or the co-planar stacking of mother boards, daughter cards or the like separated by the interfitting connector body halves.

SUMMARY OF THE INVENTION

The present invention is directed to a high density connector for connecting multiple circuits between printed circuit cards, boards, or the like. The connector consists of inter-engaging, mating first and second connector bodies formed of an electrical insulating material. One of the bodies includes at least one connection face having uniform width and height undulations forming alternating flattened peaks and valleys of limited width with the peaks and valleys having an electrically conductive coating thereon to form longitudinally spaced, transversely offset contacts at said peaks and valleys. The connector further consists of a second body including at least one connection face bearing mirror image undulations of similar, uniform width and height and forming alternating flattened peaks and valleys of limited width with said peaks and valleys being electrically conductively coated to form mirror image longitudinally separate and transversely offset contacts to those on said first connector body, wherein said bodies are in face contact with each other to complete electrical circuits between transversely abutting contacts, and wherein, the center to center distance between longitudinally adjacent contacts is less than the peak to valley distance between those contacts to increase the electrical creapage path between longitudinally adjacent contacts of said mating first and second bodies.

The high density connector may take the form of interfitting male and female bodies forming respectively a male connector half and a female connector half, said male body being of generally triangular cross sectional configuration and forming oblique side walls bearing said undulations which face away from each other, and wherein said female connector body comprises a mirror image longitudinal slot including opposed diagonal surfaces bearing undulations and said male body is insertably mounted within the slot within the female body to effect interengagement between the contacts on the peaks and within the valleys of respective opposed faces of said female and male bodies bearing said undulations.

The mated connector halves may be such that the included angle between the oblique undulating surfaces of the male connector half is slightly in excess of the included angle between the opposed undulating surfaces of the female connector half defining said slot such that there is wiping contact between the electrically conductive coatings of the peaks and valleys of the respective male and female connector halves during insertion of the male connector half into the slot of the female connector half.

The female connector half may have a cross section which is generally H-shaped and the male connector half may have a cross section which is generally V-shaped with said male connector half being formed of an elastomer material and the H-shaped female connector half being formed of a generally rigid material. The male connector half may include an inverted V-shaped slot within the base thereof to provide added resiliency to the elastic male connector half to maintain by deformation, a self-biased connection between the contacts at the peaks and valleys of the male connector half and the respective abutting peaks and valleys of the female connector half.

One or both of the connector halves may have a coating of solder mask overlying extensions of the electrically conductive coatings on the peaks and valleys which extends along companion surfaces of the connector halves. The solder mask may be selectively removed defining contact points forming areas of connector body surface contact with said board or card. Where the female connector half is of modified H-shaped cross section, the groove or slot remote from that receiving the elastic female connector half may be of rectangular cross section and may have a lateral width generally equal to the thickness of a daughter card so that an end of daughter card may be coupled thereto with the card longitudinal axis aligned with the assembled connector halves and with the daughter card at right angles to a mother card coupled to the base of the male connector half.

BRIEF DESCRIPTION OF THE DRAWINGS

FIG. 1 is an exploded view, in vertical section of an improved, high density electrical connector forming a preferred embodiment of the invention as applied to the mounting of a daughter card at right angles to a mother card through mating connector halves.

FIG. 2 is a perspective view of the male connector half of the connector shown in FIG. 1.

FIG. 3 is a top plan view of the male connector half of FIG. 2.

FIG. 4 is a perspective view of a portion of the female connector half of the connector shown in FIG. 1.

FIG. 5 is a bottom plan view of a portion of the female connector half of FIG. 4.

DESCRIPTION OF THE PREFERRED EMBODIMENT

Reference to FIGS. 1–5, inclusive, shows a preferred embodiment of the improved, high density connector of the present invention as applied specifically to the mounting of a daughter card in upright, perpendicular position with respect to an underlying horizontal mother board. The high density connector 10 functions therefore to make suitable electrical connections between electric circuitry carried by the underlying, horizontal mother board 12 and that of a vertically upright daughter card indicated generally at 14. The connector 10 consists of two mating components or connector halves, a male connector half indicated generally at 16 of generally modified, inverted V-shape cross section and a female connector half 18 of modified H-shape cross section.

The male connector half 16 is formed of an elongated block or body 20 of electrical insulating material which has a transverse cross-section of frusto-triangular form consisting of a flat top wall 22, a flat bottom wall or base 24, and laterally opposed diagonal or oblique side walls 26, 28. The electrically insulating block or body 20 includes an inverted V-shaped slot or groove 30 from the base or bottom wall 24 upwardly towards the top wall 22 but terminating short thereof. Importantly, in the illustrated embodiment, the male connector half body 20 is formed of a suitable elastomeric material such as a polyurethane D70 elastomer.

The opposed oblique lateral side walls 26, 28, are corrugated longitudinally to form alternating, equal width flattened peaks 34 and valleys 36 over the full longitudinal length of the body 20. In the illustrated embodiment, the length of both the female and male connector halves is one inch. The basic concept of the invention therefore is to provide electrical contacts along the opposed oblique sides 26, 28 of the male connector half 16, on the flat surface portions of the peaks 34 and valleys 36. Contacts are provided at 38 for the peaks, and 40 for the valleys. The electrical contacts are constituted by thin metal film deposits. The peaks and valleys may be appropriately coated by metal vapor film depositions or the like. The contacts 38, 40 may wrap around on the bottom face or base 24 of the male connector half 16 as at 38*a*, the purpose of which is to make suitable, selective electrical connection with conductor strips as at 74, FIG. 1, within or on the upper surface 12*a* of the mother card 12, the core of which card is formed of a suitable electrical insulation material. It is preferred that both the valleys and the peaks terminate in narrow flattened surfaces which when coated with an electrical conductive film form separate, flat electrically insulated contacts which may make ready connections with longitudinally offset, electrically coated valleys and peaks, respectively, of the corrugated or convoluted facing surfaces of the female connector half 10.

Referring to FIGS. 1, 2 and 3, therefore, appropriate dimensions are given for the male connector half 16 of the illustrated embodiment of the invention. The inverted V-shaped slot or groove 30 is formed so as to provide oppositely oblique side walls 43, 45 which extend upwardly from the base or bottom wall 24 over a distance Z of 0.055/0.045 inches. The oblique side wall 43, 45 are at an angle $\theta$ with the vertical center plane of the female connector half 16. The angle $\theta$, FIG. 1, may be 10°. With respect to the oblique side walls 26, 28 of the male connector half body 20, that angle $\alpha$ with the vertical center line of the male connector half body 20 is preferably equal to 15°/14°. The width Y of the slot 30 within the base or bottom wall 24 of the body 20 may be 0.020 inches.

As seen best in FIG. 3, the conductive film contacts 38, 40, at the peaks 34 and the valleys 36 of the convoluted opposed faces 26, 28 of the male connector half 16 are at 0.010 inch centers indicated at A. The distance B between contacts 34, 38 on adjacent peaks is 0.020 inches. The distance C between the ends of the contacts 40 within the valleys of the convoluted outer side walls 26, 28 of the male contact half 16 is 0.20 inches while, the length D of the sloped side walls 41 of the convolutions and thus the distance between adjacent contacts 38, 40 on the given side of the male connector half 16 is 0.015/0.014 inches. The lateral width E and thus longitudinal extent of the contact metal foil coatings 38, 40 within the valleys and on the peaks respectively of opposed side walls 26, 28 is 0.005 inches. As may be further appreciated, the unitary elastomer electrical insulating material body 20 is molded with convoluted surface peaks on 0.010 centers with a 0.015/0.014 inch lateral offset (dimension D) thus permitting a greater creapage path for electrical current shorting from one longitudinally adjacent contact at a given peak to the nearest contact within an adjacent valley to one side thereof or the other. Further, the employment of the one or more convoluted surfaces on respective members assists in aligning the connector halves during mating.

As will be appreciated in viewing FIGS. 4 and 5, the mating female connector half 18 is molded in such a way that the contacting surfaces thereof are staggered, i.e., a mirror image so that they will intermate with the convoluted surfaces 26, 28 of the female connector half 16.

Referring to FIGS. 1, 4 and 5, the female connector half 18 is also formed of a unitary body or block of electrical insulating material indicated generally at 50. Body 50 is provided with laterally opposed vertical side walls 51, 53 and includes an elongated inverted V-shaped slot or groove 55 within the bottom wall or base 57 thereof which extends vertically upwardly therefrom but is separated from an upper groove or slot 58. Slot 58 is rectangular in cross section, to form a bridge or connecting portion 56 which joins laterally opposed sides 52, 54 of body 50. The cross section configuration of the female connector half 18 is therefore of modified H-shaped configuration including laterally opposed, oblique, internal side wall surfaces 59, 61. The female connector half 18 is preferably molded of a suitable electrically insulative material which is relatively rigid such as RYTON R-402 black polyphenylsulfide. In molding or in otherwise forming the body 50, opposed oblique internal side wall surfaces 59, 61 are given a longitudinally convoluted form to create longitudinally alternating, flattened peaks 62 and valleys 64 which peaks and valleys are suitably coated with a thin, highly electrically conductive metal film. In both the male and female connector halves, 16, 18, the conductive films may be of a single metal or may be in different metal multi-layer form. Exemplary of such films to provide electrical contacts of low impedence are contacts formed of a 15u inch gold layer over 15u inch of nickel. The thin film coatings forming contacts 66 at the peaks, and 68 at the valleys of female connector half 18 may be achieved by vapor deposition or the like. The shortest distance F between contacts 66 on laterally opposed inclined faces 59, 61 of the female connector half 18 is 0.020 inches. Further, there is provided a 0.015/0.014 inch transverse offset between longitudinally adjacent peak and valley contacts 66, 68 which creates an increased creapage path between the longitudinally adjacent contacts 66, 68 at both oblique surfaces 59, 61. The width H in the body longitudinal direction, for contacts 66, 68 is equal to 0.005 inches. Again, the center to center distance I between the longitudinally adjacent contacts 66, 68 for a peak and an adjacent valley is 0.010 inches and the center-to-center distance J between adjacent peak contacts 66 (or succeeding valley contacts 68 in the longitudinal direction) is 0.020 inches, FIG. 5. Further as seen in FIG. 1, the approximate slot dimension X of the upper groove or slot 58 is generally equal to the transverse width of a daughter card 14 which daughter card 14 may be insertably mounted in vertical upright position within that slot 58. The vertical height K of the lower slot or groove 55 from the base or bottom surface 57 of the female connector half 18 to bridge 56, in the illustrated example of FIG. 1 is 0.070 inches. FIG. 1 also shows the lateral spacing F between opposed ends of the contacts 66 at the peaks 62 of opposed oblique faces 59, 61 of the H-shaped cross section female connector half 18. Additionally, FIG. 1 illustrates the oblique angle $\beta$ of opposed faces 59, 61 with respect to the vertical center plane of the female connector half 18 as ranging between 13° and 14° in contrast to the 15° to 14° angulation given to oppositely facing oblique surfaces 26, 28 of the male connector half 16.

With the oblique angle $\beta$ of the convoluted surface on the female connector half 18 being slightly less than angle $\alpha$ of the male connector half for the contacting oblique, convoluted surfaces the angles, there is guaranteed contact integrity and a wiping action between the contacts of mating halves 16, 18 as well as guaranteed maintenance of a low insertion force after the upper surface 22 of the male connector half bottoms out against the top surface 60, of the lower groove or slot 55 within the female connector half 18.

The female connector half 18 may have a coating of solder mask indicated generally at 70 which covers the laterally opposed side walls 51, 53 over the complete surface thereof with the solder mask coating 70 also covering portions of contacts at the top and bottom of the female connector half 18 leaving only the internal wall portions of respective upper and lower slots 58, 55 and the peak and valley contacts 66, 68 free of solder mask.

In the illustrated embodiment, the daughter card 14 may carry conductors as at 72 on one side face or the other for contact with the exposed ends of the female connector half contacts half 64, 66 such as at the ends **68*b* of valley contacts 68, FIG. 1**, as illustrated.

When the connector halves are interconnected, the peak contacts 38 of the male connector half 16 make sliding, wedge contact with the opposed valley contacts 68 which face each other when male connector half 16 is fitted within the lower groove or slot 55 within the female connector half 18. Simultaneously valley contacts 40 of the male connector half 16 make sliding wedge contact with opposed peak contacts 66 of the female connector half 18.

Further, as may be appreciated, the lateral width of the upper groove or slot 58 within the female connector half 18 may readily vary. Typically, that "X" width dimension may vary in increments of 0.05 inches with the slot width ranging from 0.010 to 0.060 to accept a wide variety of daughter cards 14 of corresponding width.

The improved high density connector 10 of the present invention has contacts or conductors respectively on 0.010 centers with contacts at the peaks and valleys being either plated onto the one inch length elastomer body or block 20 or the rigid plastic RYTON body or block 50, or laminated in a method similar to that used for the production of typical printed circuit boards such as the illustrated mother board 12 or the daughter card 14.

The connector 10 is used for very low current applications and while it is preferably used with mother board, daughter card applications as shown; additionally, input lines may be made thereto through flat cables or flex circuits having faces contacting the conductively coated portions of the male and female connector halves forming extensions of the contacts at the peaks and valleys of respective halves. With the angle of the oblique convoluted surfaces of the elastic male connector half being slightly greater than that shown for the female connector half 16 contact integrity and wiping action of the mating halves as guaranteed as well as maintaining a low insertion force for the elastomeric body 20 when inserted into the bottom slot or groove 55 of the rigid female connector half body 50. Further, while the connector half physically coupled to the daughter card 14 side has a coating of solder mask 70, such solder mask may cover portions of the male connector half 16 as desired or needed, particularly to prevent shorting between adjacent cards or boards during the unmating of connector halves. Further, while the material making up the male connector half body 20 may be made of a suitable elastic material having a Shure hardness of seventy for example, the elasticity of the material may readily vary. However, it is preferred that one of the two connector halves be made of an elastic material and constitute the dynamic half of the mating connector parts.

The relief or inverted V-shaped slot or groove 30 within the bottom 24 of the elastic male connector half 16 is provided for two reasons. First, the groove or slot permits cleaning of the underlying printed circuit board (mother board 12) during the soldering sequence of portions of the peak and valley contacts 40, 38 of the male connector half 16 to the conductors (spots or strips) 74 within the upper face of the mother board 12, FIG. 1. Secondly, the inverted V-shaped slot or groove 30 forms a volume permitting the material of the male connector half 16 to be displaced during mating and compression by the more rigid female connector half 18 receiving the resilient male connector half 16.

By using spring loaded locks (not shown) on the top of a card guide portion of a chassis assembly (not shown) which forces the daughter card 14 to move downwardly in the direction of arrow P under the applied pressure. FIG. 1, the connector halves 16, 18 can be guaranteed maximum mating and minimum contact resistance between the peak and valley conductive coatings of respective connector halves over the convoluted mating surfaces due to the loss of static. The initial length of the design while indicated as one inch to guarantee dimensional integrity of both connector halves 16, 18 during molding as well as during mating is not limiting. The components may be of varying length and multiple parts can be butted together to generate a connector of longer length. Further, polarization and guiding can be accomplished through auxiliary components. By eliminating upstanding side wall portions 52*a*, 54*a* of the H-shaped female connector half to change its configuration to one which is of modified, inverted U-shaped configuration, a completely flat upper surface is formed, (eliminating upper groove 58), and that flat surface may be mated directly to a second mother card appropriately connected to the female connector half 18 and lying co-planar to the mother card 12 illustrated in FIG. 1. Thus, a stacked array of mother card 12, daughter cards 14 or the like may be achieved using the connectors 10 for effecting the interconnection at 0.10 centers between conductive portions of respective cards. The fact that the contacts are on 0.010 centers is coincident with the present conventional manufacturing technique of multi-layer printed circuit boards. Thus, the present connector 10 eliminates the need to have solder pads especially designed and built onto the boards. Simply, the opening of areas on the solder mask permits the location and mounting of the connector halves to the mother board 12 for instance as illustrated in FIG. 1. In the low current application of the connectors, the current rating should not exceed one amp. In using the embodiment of the invention illustrated, the operating temperature should not exceed 150° C. Further, while the dimensions, angular relationships and the like are exemplary of an operable connector system utilizing the two components 16, 18 to achieve a desired result, the dimensions, the angles, the material making up the electrically insulating bodies 20, 50 may be readily varied as well as the contact coating from that discussed specifically with respect to the illustrated embodiment, all without departing from the scope and content of the invention as disclosed and claimed.

What is claimed is:

1. A high density connector for connecting multiple circuits between printed circuit boards and the like, said connector consisting of inter-engaging, mating first and second connector bodies formed of an electrical insulating material, one of said bodies including at least one connection face having uniform width and height undulations forming alternating flattened-peaks and valleys of limited width with the peaks and valleys having an electrically conductive coating thereon to form longitudinally spaced, transversely offset contacts at said peaks and valleys, said second connector body including a connection face bearing mirror image undulations to said at least one connection face of said first connector body of similar uniform width and height and forming alternating, flattened peaks and valleys of limited width with said peaks and valleys of said undulating connection face of said second body being electrically conductively coated to form mirror image longitudinally separate and transversely offset contacts to those on said first connector body and wherein the connection faces of said bodies are in contact with each other with electrical circuits completed between abutting contacts, and wherein the longitudinal center to center distance between longitudinally adjacent contacts is less than the peak to valley distance between those contacts to increase the electrical creapage path between longitudinally adjacent contacts of said mating first and second bodies.

2. The high density connector as claimed in claim 1, wherein said interconnecting bodies constitute male and female connector halves, said male half being of generally triangular cross sectional configuration and having oblique side walls which face away from each other which bear said undulations and which form two connection faces and wherein, said female connector half includes a mirror image longitudinal slot sized to said generally triangular cross sectional configuration male half including opposed diagonal surfaces bearing undulations and forming dual mating connection faces and wherein said male half is insertably mounted within the slot within the female half to effect interengagement between the contacts on the peaks and within the valleys of respective opposed connection faces defined by said undulation surfaces of said male and female halves.

3. The high density connector as claimed in claim 2, wherein the included angle between oblique undulating surfaces of the male connector half is slightly in excess of the included angle between the opposed undulating connection faces of the female connector half defining said slot therein to provide a wiping contact between the electrically conductive coatings of said flattened peaks and valleys of respective male and female connector halves during insertion of the male connector half into the slot of the female connector half.

4. The high density connector as claimed in claim 2, wherein the female connector half has a transverse cross section which is of general H-shape and the male connector half has a transverse cross section which is of general, inverted V-shape and wherein, said male connector half is formed of an elastomer material and said H-shaped female connector half is formed of a generally rigid material, whereby, during insertion of the male connector half into the slot of the female connector half to complete the coupling the male connector half is deformed with the resiliency of the elastomer material tending to maintain coupling between the connector halves, after slot insertion of the male connector half.

5. The high density connector as claimed in claim 4, wherein said male connector half includes an inverted V-shaped slot within the base of the male connector half to provide added resiliency to the elastic male connector half to maintain by deformation, a self-based connection between the contacts of the male and female connector halves at corresponding peaks and valleys thereof.

6. The high density connector as claimed in claim 1, wherein the electrically conductive coating on the peaks and valleys of the interfitted connector halves extend to companion surfaces of the connector bodies and wherein, a coating of solder mask overlies the extensions of the electrically conductive coating and said connector includes areas of the solder mask selectively removed at contact points along said coated companion surfaces of at least one of the connector halves for connecting the extensions of the electrically conductive coating to a printed circuit board having surface conductors exposed and aligned with respective areas of solder mask removal.

7. The high density connector as claimed in claim 2, wherein said female connector half is of modified H-shaped cross section having a second slot within the face thereof opposite to the slot receiving the male connector half, and wherein said second slot is of rectangular cross section and has a lateral width generally equal to the thickness of a daughter card and end of a daughter card is insertably mounted within said second slot with the daughter card longitudinal axis aligned with the assembled connector halves wherein, at least one face of the daughter card at the inserted end thereof includes a conductor facing and in contact with an extension of the electrically conductive coating on at least one of the peaks and valleys of the female connector half, and wherein, said connector further includes a mother card fixedly mounted to the base of the mole connector half, said mother card includes a conductor on the face thereof in contact with the base of the male connector half facing and in contact with an extension of an electrically conductive coating on at least one of the peaks and valleys of the male connector half to complete a circuit between a contact of the male connector half formed thereby and said mother card conductor.

* * * * *